United States Patent [19]

Akita et al.

[11] 4,387,584

[45] Jun. 14, 1983

[54] STEEL PIPE ROLLING MILL

[75] Inventors: Shinji Akita; Masayuki Hatanaka, both of Yokohama, Japan

[73] Assignee: Nippon Kokan Kabushiki Kaisha, Tokyo, Japan

[21] Appl. No.: 312,947

[22] Filed: Oct. 20, 1981

[30] Foreign Application Priority Data

Oct. 21, 1980 [JP] Japan ..... 55-146260
Oct. 31, 1980 [JP] Japan ..... 55-152143

[51] Int. Cl.[3] ..... B21B 31/08

[52] U.S. Cl. ..... 72/100; 72/95; 72/239

[58] Field of Search ..... 72/95, 96, 97, 100, 72/238, 239

[56] References Cited

U.S. PATENT DOCUMENTS 661,470 11/1900 Fawell et al. ..... 72/239
3,143,011 8/1964 Sieger ..... 72/238
3,566,653 3/1971 Unrath ..... 72/100
3,845,646 11/1974 Bellmann et al. ..... 72/100

FOREIGN PATENT DOCUMENTS 1441472 6/1976 United Kingdom ..... 72/97

*Primary Examiner*—Lowell A. Larson
*Attorney, Agent, or Firm*—Fleit, Jacobson & Cohn

[57] ABSTRACT

The present invention relates to an apparatus for changing the rolling-mill rolls and disk shoes of steel pipe rolling mills. The apparatus comprises mechanisms for raising and lowering a top and bottom cradle each holding a roll of a rolling mill and a carriage disposed below the bottom cradle and movable transversely, whereby the cradles are moved in and out of the rolling mill housing transversely by the carriage, and a plurality of holding devices each rotatable about a fixed shaft are selectively positioned opposite to a pair of chocks holding a pair of disk shoes for movement in parallel motion thereby changing the disk shoes.

8 Claims, 6 Drawing Figures

STEEL PIPE ROLLING MILL

The present invention relates to Mannesmann-type vertical two-roll disk-shoe type steel pipe rolling mills and more particularly to an apparatus for changing the rolling-mill rolls and disk shoes used in such rolling mills.

This type of rolling mill (a piercer, elongator or the like) is designed so that a heated material (hereinafter referred to as a billet) is passed between vertically arranged rolling rolls and a plug mounted on the forward end of a long mandrel bar is forced into the billet from the opposite side thus producing a thick-walled hollow crude pipe. Thus, the outer surfaces of the rolling rolls are pressed against the hot billet while being rotated and it is necessary to change the rolls with new rolls at times due to the wear and defects caused in the roll surfaces by a long period of service. The rolling mill also includes a pair of circular disk shoes arranged between the rolls to prevent the crude pipe from expanding between the rolls during the billet piercing operation and the outer peripheral surface of the disk shoes is formed into an arcuate shape corresponding to the external shape of billets and thus it is necessary to change the disk shoes when the outer diameter of billets changes. Also, the outer peripheral surfaces of the disk shoes are always contacted with the hot billets and consequently it is necessary to change the disk shoes at times due to the wear and defects of the disk shoes caused by their use over a long period of time.

In the past, the rolling rolls in this type of steel pipe rolling mill has been effected by first lifting and removing to other place the cover placed on the top of a housing by an overhead crane, successively lifting the top and bottom rolls mounted in the housing and moving them to a roll shop, and conveying new rolls in the roll shop to the housing and mounting them in the housing. On the other hand, changing of the disk shoes has been effected by detaching the disk shoes from the rolling mill by means of a jig or the like, lifting and transferring the disk shoes to the roll shop by the overhead crane and conveying and mounting new disk shoes in the rolling mill.

These known roll changing and disk shoe changing methods not only require much time and labor but also involve a considerable decrease in efficiency and the resulting loss due to the shut down of the rolling mill due to the roll or disk shoe changing operation. There are many other disadvantages in that the overhead crane is used exclusively during the changing operation making it impossible to use the crane for any other operation, that it is difficult to ensure a high degree of mill stiffness due to the open-top structure of the rolling mill housing and so on.

The present invention has been made with a view to overcoming the foregoing deficiencies in the prior art, and it is the object of the present invention to provide a steel pipe rolling mill wherein various mechanisms of the rolling mill are collectively arranged in the upper half of a housing so that rolling-mill rolls can be taken out from the side of the housing for changing purposes, and wherein disk shoe holding chocks are adapted to make parallel motion and disk shoe holding devices are arranged opposite to these chocks for rotation about fixed shafts so as to take out the disk shoes from the housing transversely, thereby making it possible to easily change the rolling-mill rolls and disk shoes and ensuring a greater mill stiffness.

The present invention may be better understood by reference to the detailed description which follows and to the accompanying drawings, in which.

The present invention will now be described in greater detail with reference to the illustrated embodiment.

Figure 1:
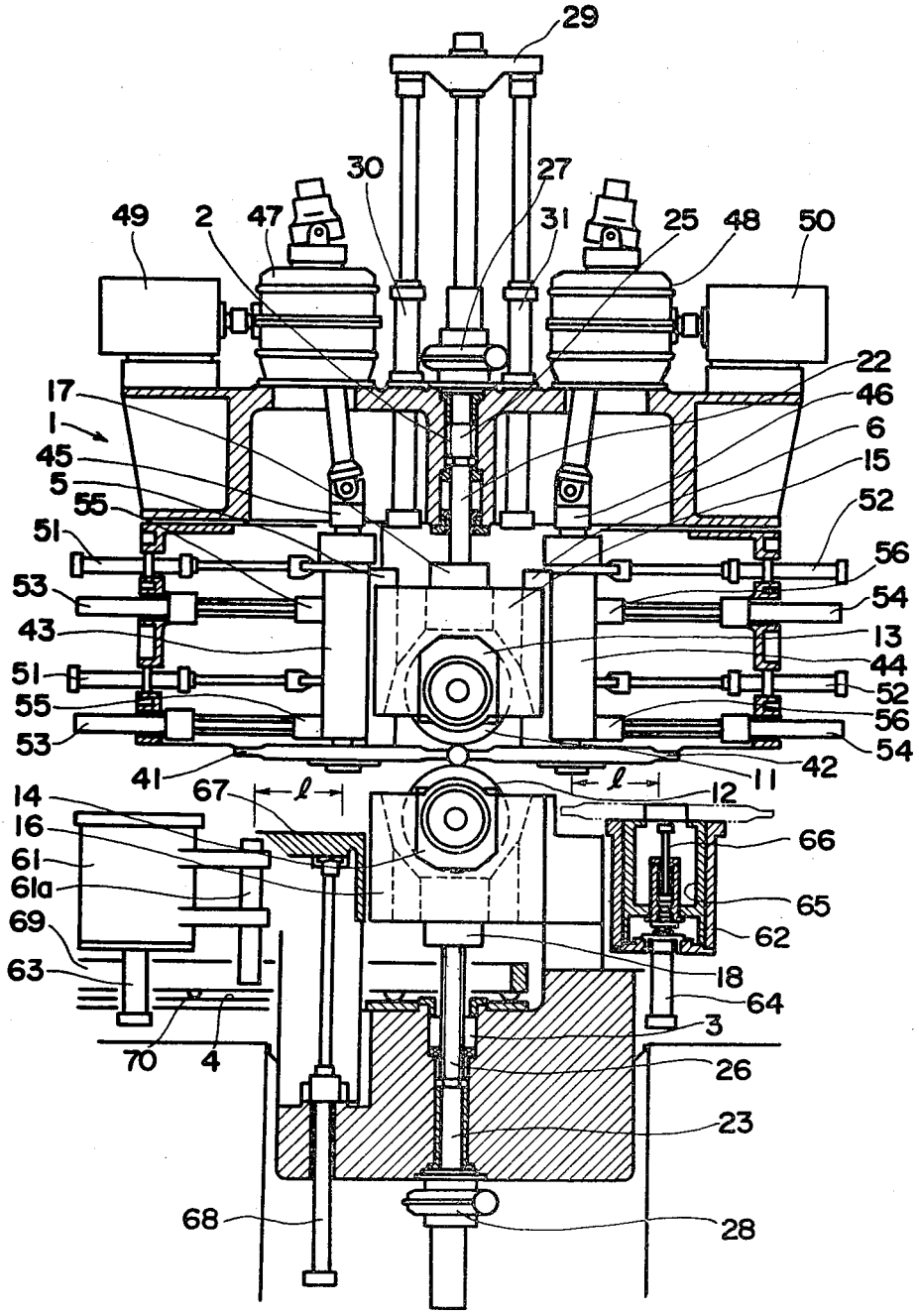
FIG. 1 is a front view showing part in section an embodiment of a steel pipe rolling mill according to the invention.
Figure 2:
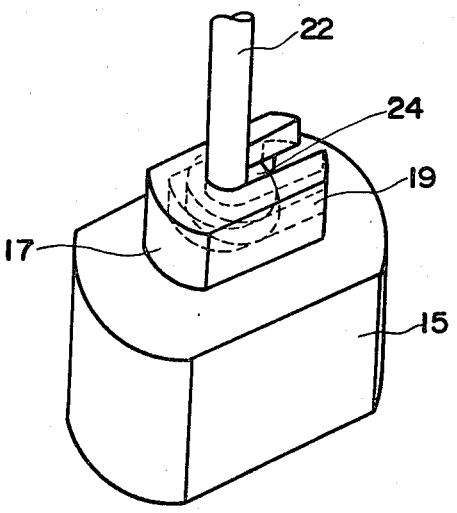
FIG. 2 is a perspective showing by way of example the manner of engagement between a supporting rod and a cradle which are used with the invention.

Referring to FIG. 1, numerals 11 and 12 designate rolling-mill rolls which are respectively supported on cradles 15 and 16 by means of chocks 13 and 14, respectively. Numerals 17 and 18 designate supporting members respectively provided on the upper surface of the cradle 15 and the lower surface of the cradle 16, each of which is provided with a stepped portion and a groove 19 having an open end as shown by way of example in FIG. 2. Numerals 22 and 23 designate supporting rods having at their one end disk blocks 24 adapted for engagement with the grooves 19. Referring again to FIG. 1, numerals 25 and 26 designate external threads formed respectively on the supporting rods 22 and 23 for engagement with internal threads 2 and 3 formed on a housing 1. Numerals 27 and 28 designate driving mechanisms such as motors which are fixedly mounted on the housing 1 for respectively rotating the supporting rods 22 and 23. Numerals 29 designates a block to which the other end of the supporting rod 22 is secured, and 30 and 31 hydraulic cylinders which are attached to the housing 1 and whose operating rods are secured to the block 29. Numerals 5 and 6 designate guides for the top cradle 15.

Numerals 41 and 42 designate disk shoes each having an arcuate peripheral surface corresponding to the outer diameter of billets. Numerals 43 and 44 designate chocks through which are extended main shafts 45 and 46, and the disk shoes 41 and 42 are respectively fastened by screws or the like to one end of the shafts 45 and 46 whose other end are respectively connected to motors 49 and 50 by way of universal joints and reduction gears 47 and 48. Numerals 51 and 52 designate hydraulic cylinders supported on the housing 1 and having their operating rods respectively connected to the chocks 43 and 44. Numerals 53 and 54 designate screw mechanisms supported on the housing 1 and having their forward ends respectively pressed against seats 55 and 56 provided on the chocks 43 and 44, so that the chocks 43 and 44 are respectively movable over a distance l in parallel motion by the hydraulic cylinders 51 and 52 and the screw mechanisms 53 and 54.

Numerals 61 and 62 respectively designate a pair of holding devices supported on the housing 1 so as to be rotated about shafts 61*a* to the end positions of movement of the chocks 43 and 44 to face them and including hydraulic cylinders 63 and 64 which are adapted to be operated to vertically move a holder 65 mounted in each of the holding devices 61 and 62. Although not shown, two units of the holding devices 61 and 62, respectively, are respectively arranged on the sides of the cradle 16. Numeral 66 designates removers for the disk shoes 41 and 42, which also serve the function of fixing the disk shoes 41 and 42 in place. The holding devices 61 and 62 are adapted to be rotatable outwardly about the supporting shafts 62*a* by driving mechanisms (not shown).

Figure 3:
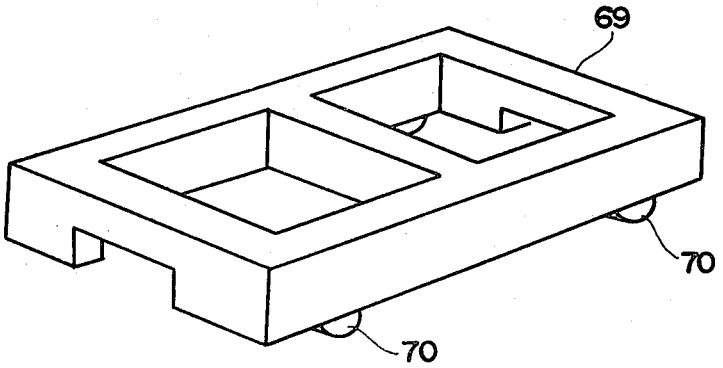
FIG. 3 is a perspective view showing by way of example a carriage used with the invention.

Numeral 67 designates a guide for the cradle 16, which is vertically movable by a hydraulic mechanism 68. Numeral 69 designates a carriage placed on a base 4 of the housing 1 below the cradle 16 and taking the form of a frame as shown by its embodiment of FIG. 3. The carriage 69 is provided with rollers 70 on its lower surface.

Figure 4:
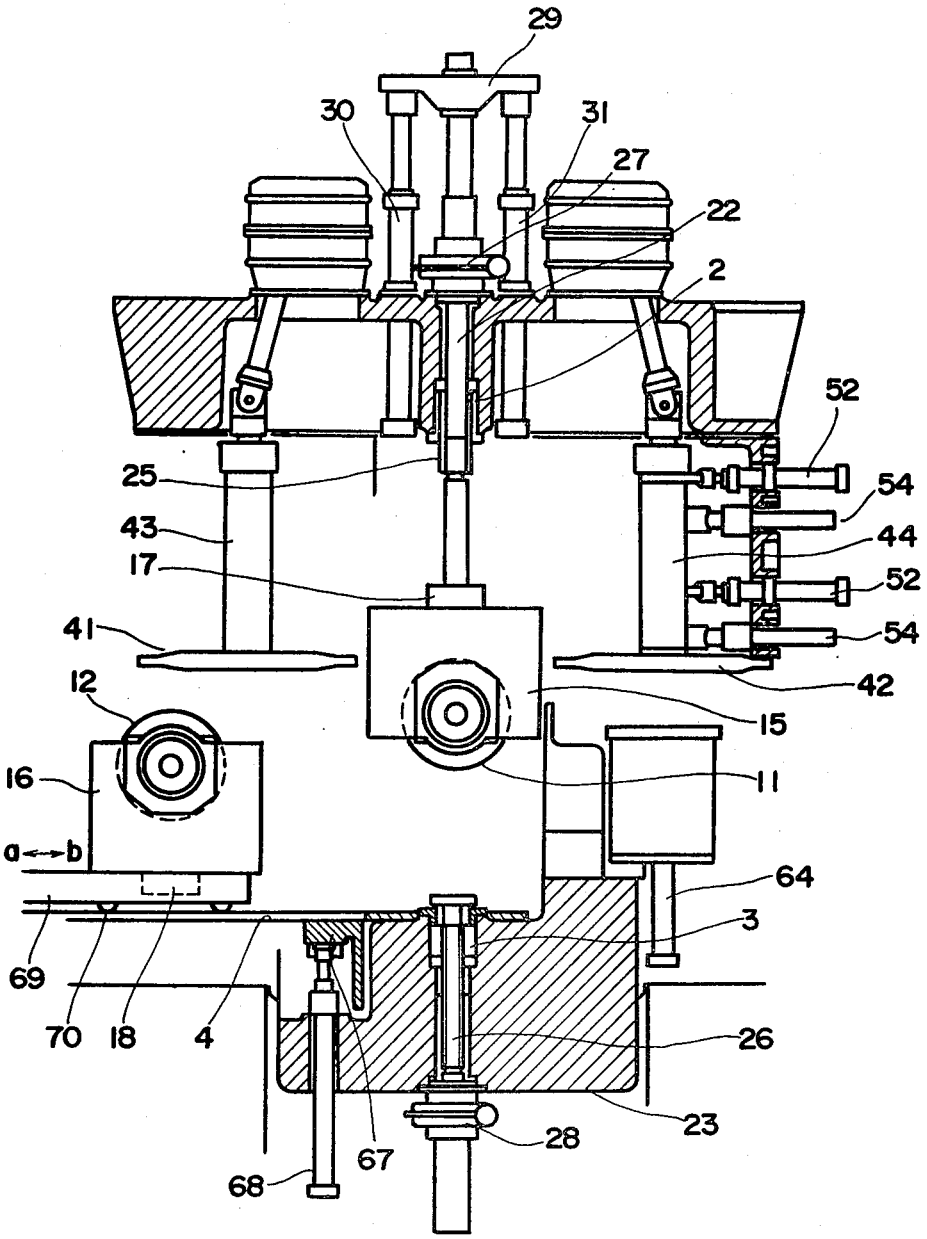
FIG. 4 is a front view of the rolling mill of this invention with a part omitted, which is useful for explaining the roll changing operation.

With the construction described above, the operation of changing the top and bottom rolls by the embodiment of this invention will be described first. To change the top and bottom rolls 11 and 12 mounted as shown in FIG. 1, as shown in FIG. 4, the guide 67 is first lowered by the hydraulic mechanism 68 to a position below the base 4 and the bottom supporting rod 23 is turned to lower and place the cradle 16 on the carriage 69. Then, the carriage 69 is moved in the direction of an arrow a, so that the cradle 16 is moved to the outside of the housing 1 and taken off the carriage 69. The carriage 69 is then moved in the direction of an arrow b back into the original position.

Then, the disk shoes 41 and 42 are respectively moved the distance l to the left and right in parallel motion by the hydraulic cylinders 51 and 52 and the screw mechanisms 53 and 54 and the center is opened. In this condition, the supporting rod 22 is rotated by the motor 27 so that the external thread 25 is disengaged with the internal thread 2 on the housing 1 and set free, thus causing the cradle 15 to be supported by the hydraulic cylinders 30 and 31. Then, the hydraulic cylinders 30 and 31 are operated so that the cradle 15 is lowered gradually along the guides 5 and 6 and placed on the carriage 69 and the carriage 69 is moved in the direction of the arrow a. When this occurs, the supporting rod 22 disengages with the supporting member 17 of the cradle 15 and the cradle 15 is moved to the outside of the housing 1 and taken off the carriage 69.

To mount a new rolling roll in the housing 1, a top cradle 15*a* with a new roll 11*a* mounted therein is placed on the carriage 69 and the carriage 69 is moved in the direction of the arrow b, thereby engaging the block 24 with a groove 19*a* in a supporting member 17*a* of the cradle 15*a*. Then, the hydraulic cylinders 30 and 31 are operated so that the cradle 15*a* is raised and the external thread 25 is engaged with the internal thread 2. In this condition, the supporting rod 22 is rotated and the cradle 15*a* is placed in the normal position. In the like manner, a new bottom cradle 16*a* is put in the normal position by the supporting rod 23 and the guide 67 is moved back to the original position. Lastly, the disk shoes 41 and 42 are moved inwardly the distance l in parallel motion and fine adjustments are made to the relative positions of the rolling rolls 11*a* and 12*a* and the disk shoes 41 and 42 by means of the threads 25 and 26 on the supporting rods 22 and 23 and the screw mechanisms 53 and 54 of the chocks 43 and 44.

While, in the above-description, the disk shoes 41 and 42 are moved outwardly in parallel motion, the disk shoes 41 and 42 may be romoved in their original positions or they may be rotated outwardly from their original positions. Also, while the blocks 24 mounted on the supporting rods 22 and 23 are engaged with the grooves 19 formed in the supporting members 17 and 18 of the cradles 15 and 16, the method of engaging the two is not limited to the described one and any other engaging means may be used. The remaining construction of this invention is not limited to the above-described embodiment and it is only necessary to arrange so that the top and bottom cradles are moved vertically and they are then moved in and out of the housing transversely.

Figure 5:
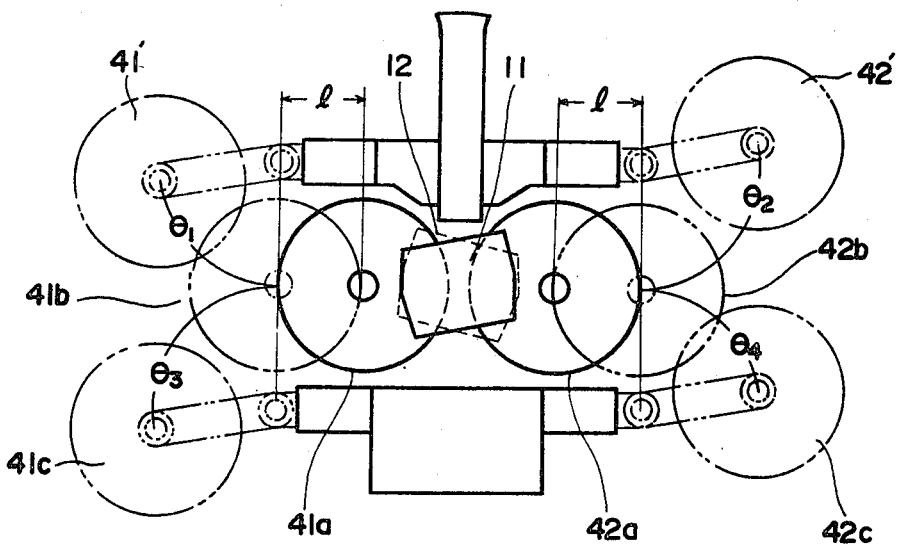
FIGS. 5 and 6 show respectively a schematic plan view and front view of the rolling mill of this invention, which are useful for explaining the disk shoe changing operation.
Figure 6:
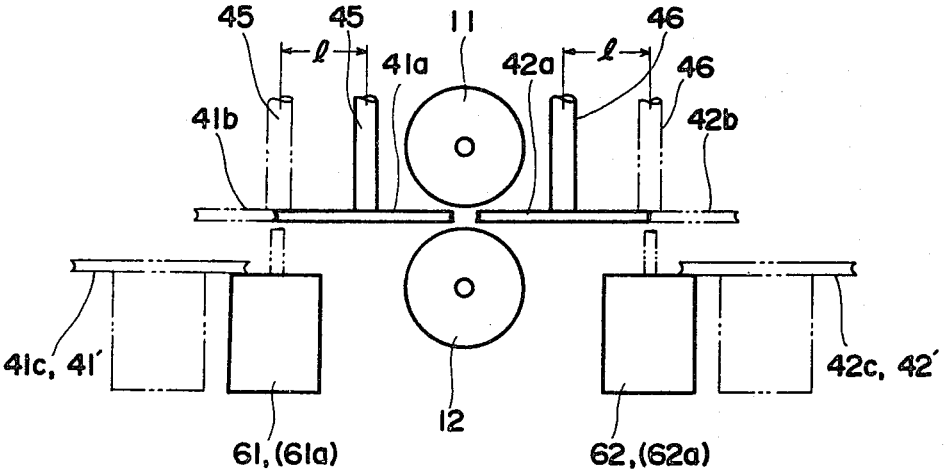

The changing operation of the disk shoes will now be described with reference to FIGS. 5 and 6. In the discussion to follow, it is assumed that the disk shoes 41 and 42 to be changed are in the positions of FIG. 1 and they are designated at 41*a* and 42*a* in FIGS. 5 and 6. In operation, the chocks 43 and 44 are moved the distance l in parallel motion by the hydraulic cylinders 51 and 52 and the screw mechanisms 53 and 54 and the disk shoes 41*a* and 42*a* are respectively moved to positions 41*b* and 42*b*. On the other hand, the holding devices 61 and 62 on one side are respectively moved from their positions 41' and 42' through angles $\Theta_1$ and $\Theta_2$ to the positions respectively opposing the disk shoes 41*b* and 42*b*. (The operation of only the holding device 62 will now be described).

In this condition, the holder 65 is raised by the hydraulic cylinder 64 of the holding device 62 and then the disk shoe 42*b* is removed by the remover 67. Then, the holder 65 is lowered by the hydraulic cylinder 64 thus transferring the disk shoe 42*b* from the main shaft 46 onto the holding device 62. With the disk shoe 42*b* now placed on the holder 65, the holding device 62 is again rotated outwardly through the angle $\Theta_2$ and returned to the original position. The disk shoes is indicated at 42'.

Then, the other holding device 62*a* preliminarily equipped with a new disk shoe 42*c* is rotated inwardly through an angle $\Theta_4$ to the position opposite to the main shaft 46 and the holder 65*a* is raised. Then the disk shoe 42*c* is attached to the main shaft 46 by the remover 66*a* and the holder 65*a* is lowered. By moving the chock 44 again the distance l inwardly in parallel motion, the disk shoe 42*c* is placed in the normal position. If the outer peripheral surface of the disk shoe 42*c* does not conform with the outer surface of the billet, a fine adjustment is effected by the screw mechanism 54.

On the other hand, the disk shoe 42' transferred onto the holding device 62 is taken off the holding device 62 and it is repaired for reuse or scrapped. Also, a new disk shoe is placed on either one of the holding devices 62 and 62*a* in preparation for the next changing. The left-side disk shoe 41 can also be changed through the similar sequence of operations.

In accordance with the present invention, the disk shoes can be changed through a different sequence of operations. More specifically, a new disk shoe is placed on each of the holding devices 61 and 62, and the chocks 43 and 44 equipped with the disk shoes 41 and 42 which have been in use are moved outwardly in parallel motion and the other holding devices 61*a* and 62*a* carrying no disk shoe are inwardly rotated. Then, the disk shoes 41 and 42 are placed on the holding devices 61*a* and 62*a* which are in turn rotated outwardly. On the other hand, the holding devices 61 and 62 carrying the new disk shoes are rotated to the positions opposite to the chocks 43 and 44 and the holders 65 are raised thereby mounting the new disk shoes on the chocks 43 and 44. Then, the holders 65 are lowered and the chocks 43 and 44 are rotated inwardly in parallel motion, thus placing the disk shoes in the normal positions. It will be convenient for the next changing operation if the holding devices 61 and 62 are rotated again to the original positions and a new disk shoe is placed on each of the holding devices 61 and 62 or 61*a* and 62*a* in preparation for the next changing operation.

What is claimed is:

1. In a steel pipe rolling mill of the type including a housing, a top and bottom rolling roll, a top and bottom cradle for respectively holding said top and bottom rolling rolls, and a pair of disk shoes, the improvement comprising:

means for raising and lowering said top and bottom cradles; and a carriage arranged below said bottom cradle and movable transversely, whereby said top and bottom cradles are successively moved in and out of said housing transversely by said carriage.

2. In a steel pipe rolling mill of the type including a pair of disk shoes, the improvement comprising:

a plurality of disk shoe holding means each rotatable about a fixed shaft, whereby said holding means are selectively moved into positions opposite to a pair of chocks holding said disk shoes so as to be movable in parallel motion, thereby changing said disk shoes.

3. In a steel pipe rolling mill of the type including a housing, a top and bottom rolling roll, a top and bottom cradle for respectively holding said top and bottom rolling rolls, and a pair of disk shoes, the improvement comprising:

means for raising and lowering said top and bottom cradles;

a pair of chocks each arranged on one side of said top cradle to hold one of said disk shoe at the lower end thereof, said chocks being movable in parallel motion;

a carriage arranged below said bottom cradle and movable transversely; and two pairs of holding means each pair thereof being arranged on one side of said bottom cradle, each of said holding means rotatably mounted on a fixed shaft, whereby said top and bottom cradles are changed by successively moving the same in and out of said housing transversely by said carriage, and whereby said chocks are moved in parallel motion each so as to be positioned opposite to one of said holding means thereby changing said disk shoes by said holding means successively.

4. A steel pipe rolling mill according to claim 1 or 3, wherein said means for raising and lowering said top and bottom cradles includes a pair of supporting rods vertically arranged opposite to each other, each of said supporting rods having on a part thereof an external thread adapted for engagement with an internal thread formed on said housing and adapted to be rotated by driving means, and wherein a lower end of one of said rods is detachably coupled to an upper surface of said top cradle, and an upper end of the other of said rods is detachably coupled to a lower surface of said bottom cradle.

5. A steel pipe rolling mill according to claim 1 or 3, further including guide means for said bottom cradle, said guide means being vertically movable by hydraulic means.

6. A steel pipe rolling mill according to claim 1 or 3, wherein said carriage has a frame structure and includes a plurality of rollers mounted on the lower surface thereof.

7. A steel pipe rolling mill according to claim 2 or 3, wherein said chocks carrying said disk shoes are movable in parallel motion by hydraulic means.

8. A steel pipe rolling mill according to claim 2 or 3, wherein each of said holding means includes therein a holder vertically movable by hydraulic means and disk shoe removing means.

* * * * *